US010913099B2

(12) United States Patent
Mihailescu

(10) Patent No.: US 10,913,099 B2
(45) Date of Patent: Feb. 9, 2021

(54) END GROOVING SYSTEM AND PROCESS FOR TUBING

(71) Applicant: Zekelman Industries, Inc., Chicago, IL (US)

(72) Inventor: Gheorghe Mihailescu, Chicago, IL (US)

(73) Assignee: ZEKELMAN INDUSTRIES, INC., Chicago, IL (US)

( * ) Notice: Subject to any disclaimer, the term of this patent is extended or adjusted under 35 U.S.C. 154(b) by 268 days.

(21) Appl. No.: 16/184,592

(22) Filed: Nov. 8, 2018

(65) Prior Publication Data

US 2020/0147664 A1 May 14, 2020

(51) Int. Cl.
*B21D 17/04* (2006.01)
*B21D 41/04* (2006.01)
*B21D 22/02* (2006.01)

(52) U.S. Cl.
CPC ..... *B21D 17/04* (2013.01); *B21D 22/025* (2013.01); *B21D 41/04* (2013.01)

(58) Field of Classification Search
CPC ..... B21D 17/00; B21D 17/02; B21D 17/025; B21D 17/04; B21D 22/025; B21D 51/2607; B21D 41/04
USPC ..... 72/107–110, 370.21
See application file for complete search history.

(56) References Cited

U.S. PATENT DOCUMENTS 3,995,466 A * 12/1976 Kunsman ..... B21D 17/04 72/106
6,935,152 B2 * 8/2005 Dole ..... B21D 17/04 72/105
2013/0298630 A1 * 11/2013 Wang ..... B21D 5/12 72/121
2014/0174305 A1 * 6/2014 Kong ..... B21D 43/05 100/193
2015/0114072 A1 * 4/2015 Baudy ..... B21D 17/02 72/370.04
2017/0144261 A1 * 5/2017 Lee ..... B21D 53/022
2019/0047033 A1 * 2/2019 Pan ..... B21D 22/025

FOREIGN PATENT DOCUMENTS

EP 2522528 A1 * 11/2012 ..... B44B 5/00
WO WO-2005094303 A2 * 10/2005 ..... F16L 17/04

* cited by examiner

*Primary Examiner* — Shelley M Self
*Assistant Examiner* — Katie L. Parr
(74) *Attorney, Agent, or Firm* — BakerHostetler

(57) ABSTRACT

A groove forming station configured to simultaneously form a groove on an end of a plurality of tubes includes a conveyor system configured to receive one of the plurality of tubes and align the one of the plurality of tubes for a subsequent grooving process; a first groove forming device configured to form a first groove on one end of a plurality of tubes; a second groove forming device configured to form a second groove on another end of the plurality of tubes. The conveyor system is configured to convey the plurality of tubes to the first groove forming device; and the conveyor system being further configured to convey the plurality of tubes to the second groove forming device.

20 Claims, 14 Drawing Sheets

END GROOVING SYSTEM AND PROCESS FOR TUBING

FIELD OF THE DISCLOSURE

The disclosure relates generally to an end grooving system for tubing. More particularly, the disclosure relates to an end grooving system for tubing configured for simultaneous operation on a plurality of tubes. The disclosure also relates generally to an end grooving manufacturing process for tubing. More particularly, the disclosure also relates to an end grooving manufacturing process for tubing for simultaneous operation on a plurality of tubes in-line in a tube mill.

BACKGROUND OF THE DISCLOSURE

Typically, a pipe or tube is manufactured by taking a piece of steel strip, and rolling it into a cylinder. After rolling, the formed tube is welded using various welding techniques known in the art. Moreover, further manufacturing processes can typically be included as well. Additionally, it is often beneficial to provide a groove at the end of the tube. Typically, the process of adding the groove to the end of the tube is accomplished manually one at a time by a factory worker. This process is slow and subject to inaccuracies as well as reduced efficiencies.

Thus, there is a need to automate the end grooving process of a tube to increase speed as well as improve quality.

SUMMARY OF THE DISCLOSURE

The foregoing needs are met, to a great extent, by the disclosure, wherein in one aspect an apparatus, system, and process is provided that implements an automated end grooving system and process for tubing.

One general aspect includes a groove forming station configured to simultaneously form a groove on an end of a plurality of tubes, including: a conveyor system configured to receive one of the plurality of tubes and align the one of the plurality of tubes for a subsequent grooving process; a first groove forming device configured to form a first groove on one end of a plurality of tubes; the first groove forming device including first inner tools configured to be each inserted into different ones of the plurality of tubes and first outer tools configured to each contact an outer surface of different ones of the plurality of tubes to form the first groove on one end of the plurality of tubes; a second groove forming device configured to form a second groove on another end of the plurality of tubes; and the second groove forming device including second inner tools configured to be each inserted into different ones of the plurality of tubes and second outer tools configured to each contact an outer surface of different ones of the plurality of tubes to form the second groove on another end of the plurality of tubes, where the conveyor system is configured to convey the plurality of tubes to the first groove forming device; and where the conveyor system being further configured to convey the plurality of tubes to the second groove forming device.

One general aspect includes a groove forming process for simultaneously forming a groove on an end of a plurality of tubes, including: receiving one of the plurality of tubes and aligning the one of the plurality of tubes for a subsequent grooving process with a conveyor system; forming a first groove on one end of a plurality of tubes with a first groove forming device; implementing the first groove forming device with first inner tools configured to be each inserted into different ones of the plurality of tubes and first outer tools configured to each contact an outer surface of different ones of the plurality of tubes to form the first groove on one end of the plurality of tubes; forming a second groove on another end of the plurality of tubes with a second groove forming device; and implementing the second groove forming device with second inner tools configured to be each inserted into different ones of the plurality of tubes and second outer tools configured to each contact an outer surface of different ones of the plurality of tubes to form the second groove on another end of the plurality of tubes, where the conveyor system is configured to convey the plurality of tubes to the first groove forming device; and where the conveyor system being further configured to convey the plurality of tubes to the second groove forming device. Other aspects include corresponding computer systems, apparatus, and computer programs recorded on one or more computer storage devices, each configured to perform the actions of the methods.

There has thus been outlined, rather broadly, certain aspects of the disclosure in order that the detailed description thereof herein may be better understood, and in order that the present contribution to the art may be better appreciated. There are, of course, additional aspects of the disclosure that will be described below and which will form the subject matter of the claims appended hereto.

In this respect, before explaining at least one aspect of the disclosure in detail, it is to be understood that the disclosure is not limited in its application to the details of construction and to the arrangements of the components set forth in the following description or illustrated in the drawings. The disclosure is capable of aspects in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the disclosure. It is important, therefore, that the claims be regarded as including such equivalent constructions insofar as they do not depart from the spirit and scope of the disclosure.

DETAILED DESCRIPTION

Figure 1:
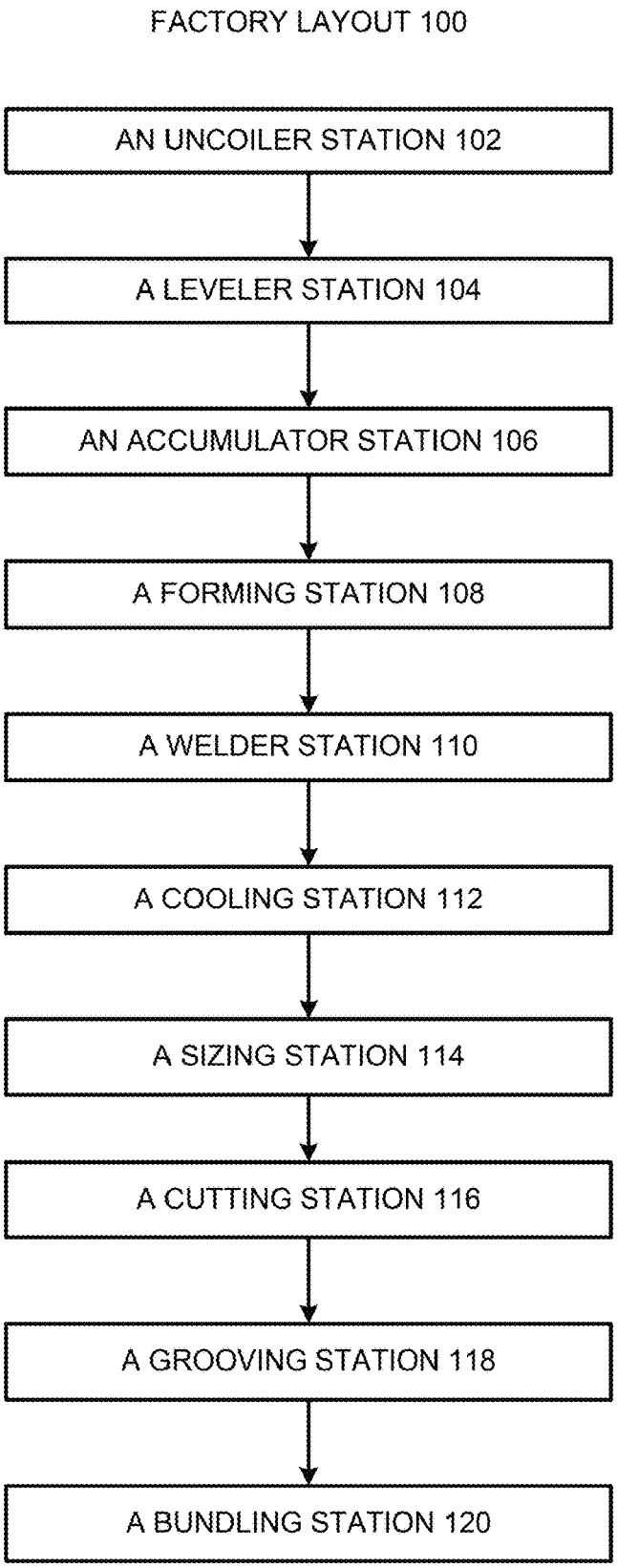
FIG. 1 schematically illustrates an exemplary factory layout utilizing a tube roll grooving station according to an aspect of the disclosure.

The disclosure will now be described with reference to the drawing figures, in which like reference numerals refer to like parts throughout. An aspect in accordance with the disclosure provides an end grooving system and process for tubing on a production line.

FIG. 1 schematically illustrates an exemplary factory layout utilizing a tube roll grooving station according to an aspect of the disclosure.

The factory layout 100 may include various stations including one or more of an uncoiler station 102, a leveler station 104, an accumulator station 106, a forming station 108, a welder station 110, a cooling station 112, a sizing station 114, a cutting station 116, a grooving station 118, and a bundling station 120. However, in some aspects there may be other stations (not shown) that may be included in the factory layout 100. In some aspects the stations may be combined. In some aspects one or more stations may not be utilized in dependence on the implementation.

At the uncoiler station 102, one or more rolled steel coils may be present and ready to be uncoiled into sheets of steel. The rolled steel coils may be positioned on arms and powered by coil keepers (not shown). The coils may also be sorted into different widths or sizes in order to manufacture the desired pipe diameter and length. The rolled steel coils may be uncoiled from the coil keepers using various techniques and fed into the leveler station 104. Additionally, in one aspect, the unrolled steel coils may be joined together by welding in order to create larger sheets of steel having similar width or size. A strip flattener may be utilized to flatten the ends sufficiently for welding and then using an end welder to shear the trailing edge of the first coil and the leading edge of the next coil, so that the two pieces can be welded together.

At the leveler station 104, the uncoiled steel coils may be flattened using pinch rollers, as known in the art, and fed into an accumulator station 106. The steel coils may be accumulated at the accumulator station 106 ready to be formed into various sized pipes. Strips of the steel coils may be stored horizontally or vertically in the accumulator station 106. From the accumulator station 106, the strips of steel coil may be fed into a forming station 108, where they may be formed into tubes using a series of forming rolls by initially forming into a U-shaped and then into a cylindrical shape with open edges. The formed tubes may then be fed into the welder station 110 where the open edges are welded by heating the open edges to a welding temperature through high frequency welding, and press welded by forge rolls. After welding, the weld flash that occurred outside and inside of the pipe may be trimmed using cutting tools such as a carbide tool. Threads at each end of the pipe may also be formed. If the pipe will be used in a harsh environment, various dipping and spraying techniques and heat treatments may be utilized in order to apply protective coatings such as a rustproof coating. In addition to or alternatively, if longer lengths of piping are needed, then additional scarf welding may be performed at the welder station 110.

After the welding is performed, the welded tubes are fed into the cooling station 112 where water or other coolant may be used to cool the welded tubes. Then cooled welded tubes are fed into the sizing station 114 where the welded tubes may be sized or reshaped as needed. This process also allows for stress relief of the water tubes so that properties are normalized in the tubes. After the sizing station 114, the welded tubes may be fed into the cutting station 116, where test samples of the welded tubes may be cut using a saw and also the desired length of the tube may be cut.

After the cutting station 116, a groove may be formed at one or both ends of the tube in a grooving station 118. Alternatively, the grooving station 118 may be arranged chronologically between other stations as described herein. Details of the grooving station 118 are described in greater detail below.

Finally, the welded tubes are fed into a bundling station 120. Prior to the bundling station 120, the various pipes that were formed may be inspected and then sent to the bundler to be bundled together for shipping. It should be noted that the stations are exemplary and that the various processes that are described for each station may be performed at other stations and/or more or less stations may be utilized depending on the type of pipe being manufactured. In a particular aspect, the factory layout 100 may be implemented as a tube mill. Further in this aspect, the grooving station 118 may be implemented in the tube mill. In yet a further aspect, the grooving station 118 may be implemented in-line in the tube mill. This in-line configuration of the grooving station 118 in the tube mill provides numerous manufacturing efficiencies, reduces manufacturing time, and/or the like consistent with the disclosure.

Figure 2:
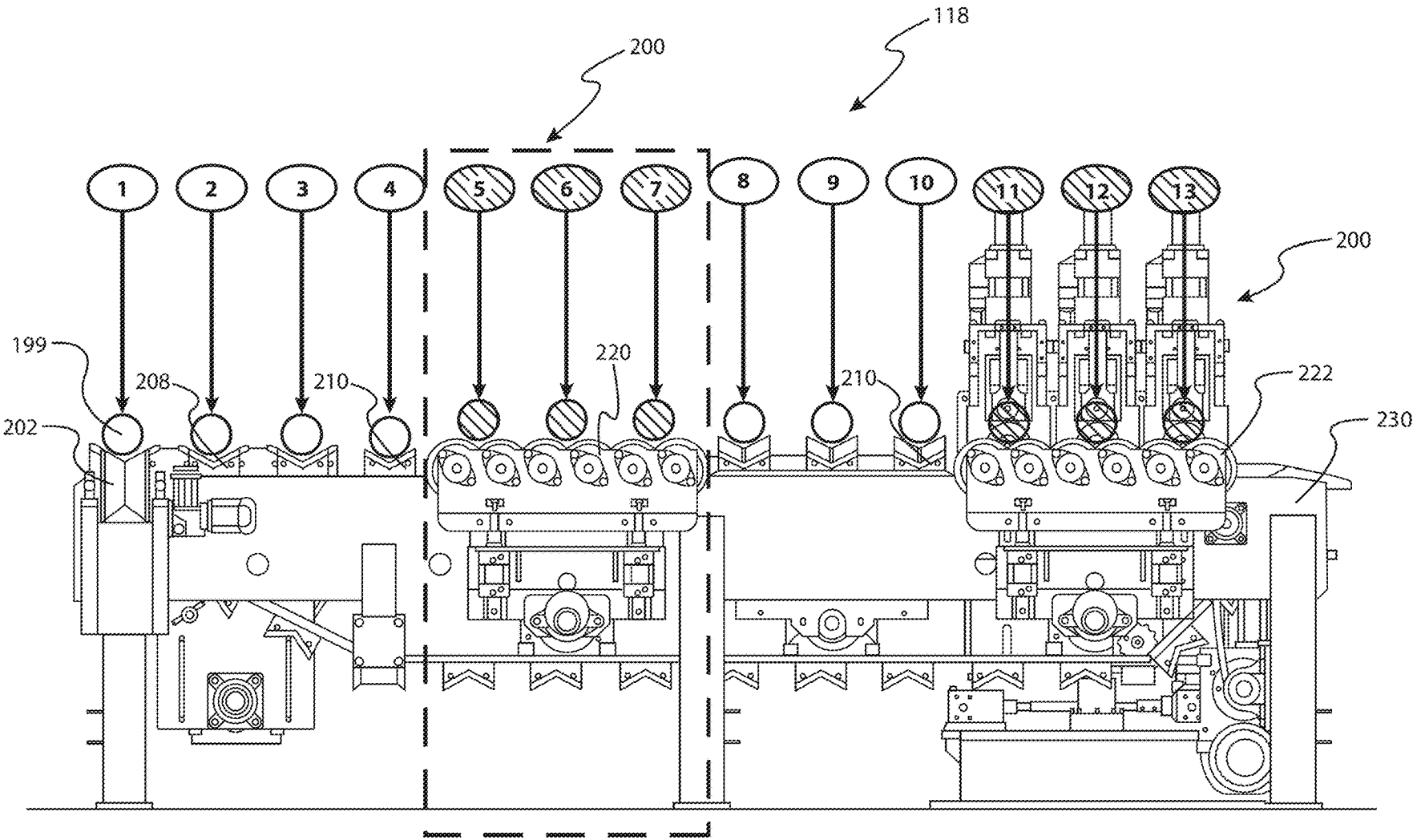
FIG. 2 illustrates a side view of a tube grooving station according to an aspect of the disclosure.
Figure 3:
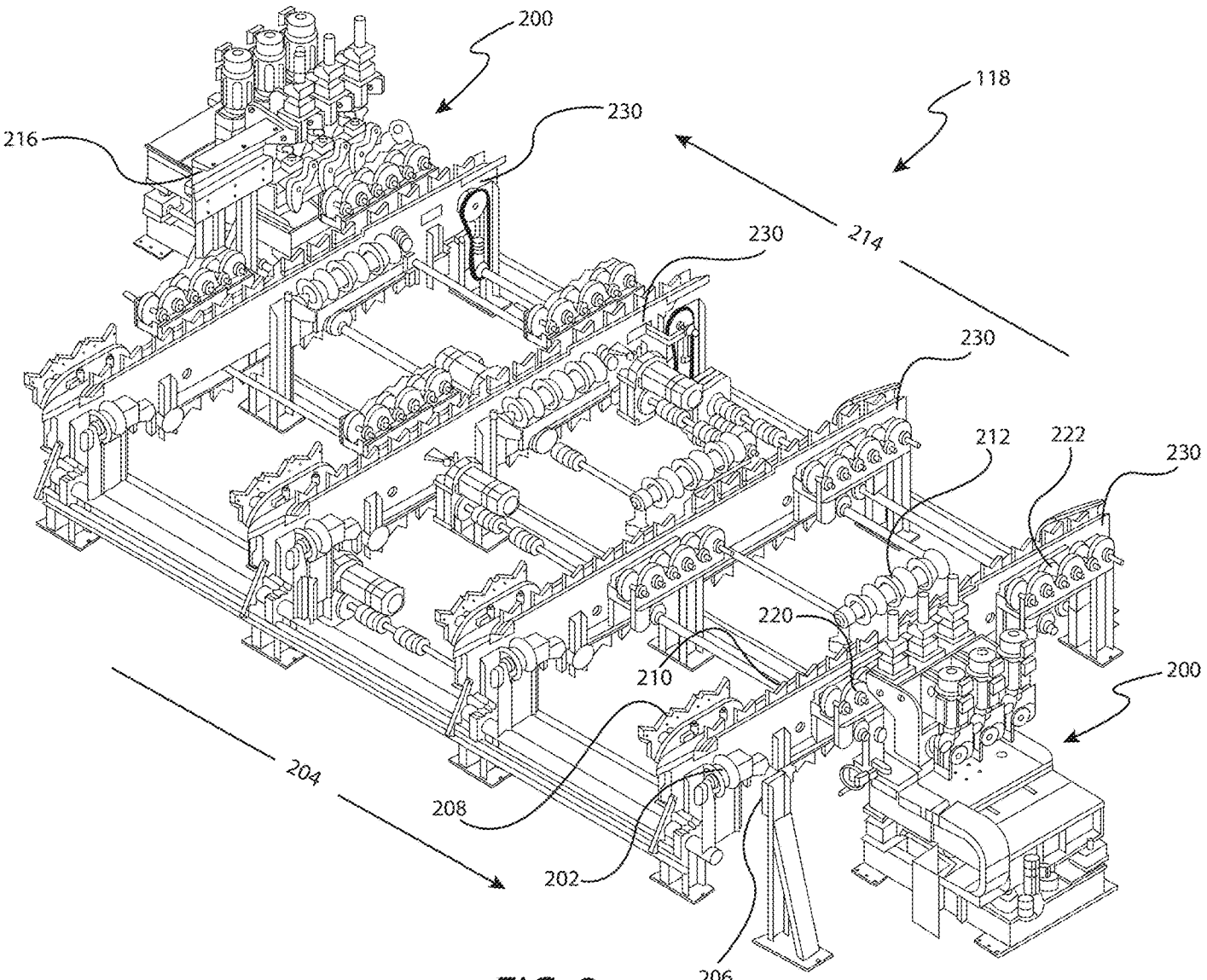
FIG. 3 illustrates a perspective view of the tube grooving station according to FIG. 2.

FIG. 2 illustrates a side view of a tube grooving station according to an aspect of the disclosure; and FIG. 3 illustrates a perspective view of the tube grooving station according to FIG. 2.

In particular, FIG. 2 illustrates the grooving station 118 as well as the 13 positions that a tube 199 may be positioned during the groove forming process. The arrangement and number of the positions in the grooving station 118 are merely exemplary and can be modified as needed depending on the implementation. The grooves on each end of the tube 199 may be formed by a groove forming machine 200. As further shown in FIG. 2 and FIG. 3, in some aspects there may be two groove forming machines 200. In this aspect, a groove forming machine 200 may be arranged at opposite sides of the grooving station 118 to form a groove on each end of the tube 199. In this regard, FIG. 2 illustrates one groove forming machine 200 in detail and the second groove forming machine 200 with a dashed line for ease of illustration; and FIG. 3 shows more clearly the position of each groove forming machine 200 implemented in the grooving station 118. In this regard, the arrangement of the groove forming machines 200 on each side of the tubes 199 results in increased manufacturing speed.

During the manufacturing process, the tubes 199 may be received from a conveyor system to the grooving station 118 initially at position 1 as illustrated on the left side of FIG. 2. At position 1, the tube 199 may be deposited on the grooving station 118 and aligned. In this regard, the tube 199 in position 1 may be placed on a parallel set of conveyor rollers 202. The conveyor rollers 202 may be driven such that the tube 199 is urged in the direction of arrow 204 to abut against a surface 206 as illustrated in FIG. 3. Once the tube 199 abuts against the surface 206, the tube 199 is now aligned for subsequent grooving. In this regard, the automated alignment implemented by the grooving station 118 in position 1, as described above, helps ensure that the tube 199 receives the groove at the appropriate location on the tube 199. In one aspect, the conveyor rollers 202 may have a V-shaped cross-section to ensure that the tube 199 remains in the central portion of the conveyor rollers 202.

The tube 199 may continue to move in the right direction from position 1, to position 2, to position 3, to position 4 with one or more conveying systems. In this regard, the tube 199 may be moved in the right direction on a stepper conveyor 208 and may be moved in groups of three. However, any number of the tubes 199 may be incrementally moved through the various positions in the grooving station 118. The stepper conveyor 208 may include a V-shaped cross-section support to ensure that the tube 199 remains in the central portion of the stepper conveyor 208. In one aspect, the stepper conveyor 208 may include three V-shaped cross-sections to ensure that three tubes 199 remain in a central portion of each of the three V-shaped cross-sections of the stepper conveyor 208.

From positions 2, 3, 4 the already aligned tubes 199 may be translated to positions 5, 6, 7. The translation of the tubes 199 through positions 5, 6, 7 may be on a chain conveyor 210. The chain conveyor 210 may include a plurality V-shaped cross-sections to ensure that each tube 199 remains in a central portion of a V-shaped cross-section of the chain conveyor 210.

In position 5, the first tube 199 may have a groove formed thereon by the groove forming machine 200 as described in greater detail below. In position 6, the second tube 199 may have a groove formed by the groove forming machine 200 thereon as described in greater detail below. In position 7, the third tube 199 may have a groove formed thereon by the groove forming machine 200 as described in greater detail below. Accordingly, three tubes 199 may receive a groove on one end simultaneously. In this regard, the simultaneous formation of grooves on a plurality of tubes 199 results in increased manufacturing speed. Of course a different number of tubes 199 may receive a groove on one end simultaneously as well consistent with the disclosure.

In this regard, in correspondence with positions 5, 6, 7 a series of drive rollers 220 may be raised and rotated so as to allow the tools of the groove forming machine 200 to be inserted inside the tubes 199 as well as pressed against the outside of the tubes 199. Thereafter, the drive rollers 220 may be rotated and lowered so as to allow the tools of the groove forming machine 200 to be removed from inside the tubes 199. Additionally, the groove forming machine 200 may translate to and from the tubes 199 utilizing a hydraulic or electromechanical device before and after the formation of the grooves on the tubes 199. In aspects that utilize a hydraulic actuator, hydraulic power packs may be included therewith.

After formation of a groove on each of the tubes 199, the tubes 199 may move to positions 8, 9, and 10. The movement may be controlled by the chain conveyor 210. In positions 8, 9, and 10, the first tube 199, the second tube 199, and the third tube 199 may be aligned with respect to an opposite side.

In this regard, the tubes 199 in positions 8, 9, and 10 may be placed on a parallel set of conveyor rollers 212 (see FIG. 3). The conveyor rollers 212 may be driven such that the tubes 199 are urged in the direction of arrow 214 to abut against a surface 216. Once the tubes 199 abut against the surface 216, the tubes 199 are now aligned for subsequent grooving. Here again, the automated alignment implemented by the grooving station 118 in positions 8, 9, and 10, as described above, helps ensure that the tubes 199 receive grooves at the appropriate location on the tubes 199. In one aspect, the conveyor rollers 212 may have V-shaped cross-sections to ensure that the tubes 199 remain in the central portion of the conveyor rollers 212.

In position 11, the first tube 199 may have a groove formed thereon on an opposite end by the groove forming machine 200 as described in greater detail below. In position 12, the second tube 199 may have a groove formed on an opposite end by the groove forming machine 200 thereon as described in greater detail below. In position 13, the third tube 199 may have a groove formed thereon on an opposite end by the groove forming machine 200 as described in greater detail below.

In this regard, in correspondence with positions 11, 12, 13 a series of drive rollers 222 may be raised and rotated so as to allow the tools of the groove forming machine 200 to be inserted inside the tubes 199 as well as pressed against the outside of the tubes 199. Thereafter, the drive rollers 222 may be rotated and lowered to move the tubes 199 away from the groove forming machine 200 so as to allow the tools of the groove forming machine 200 to be removed from inside the tubes 199. In one aspect, when the drive rollers 222 are lowered they may deposit the tubes 199 on the chain conveyor 210. Additionally, the groove forming machine 200 may translate to and from the tubes 199 utilizing a hydraulic or electromechanical device before and after the formation of the grooves on the tubes 199.

In one aspect, the conveyor rollers 202, the stepper conveyor 208, the chain conveyor 210, the drive rollers 220, the drive rollers 222, and the like may each be mounted, supported, or the like on a frame 230. As shown in FIG. 3, in one aspect there may be a plurality of frames 230 with each having a set of the conveyor rollers 202, the stepper conveyor 208, the chain conveyor 210, the drive rollers 220, the drive rollers 222, and the like. Accordingly, there may be a plurality of sets of the conveyor rollers 202, the stepper conveyor 208, the chain conveyor 210, the drive rollers 220, the drive rollers 222, and the like for movement of the tubes 199 through the grooving station 118.

Figure 4:
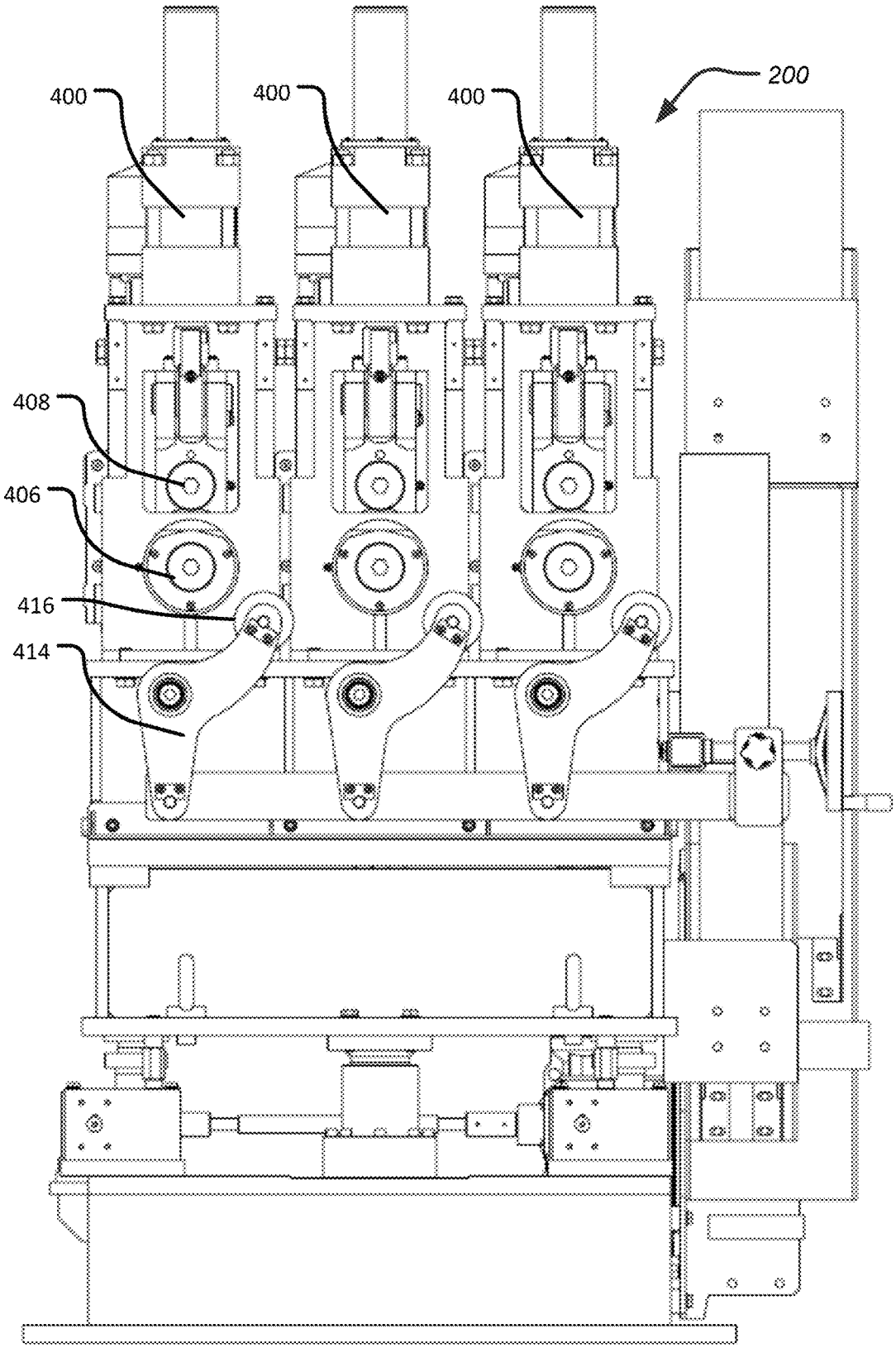
FIG. 4 illustrates a front view of a groove forming machine according to an aspect of the disclosure.

FIG. 4 illustrates a front view of a groove forming machine according to an aspect of the disclosure.

In particular, as illustrated in FIG. 4 the groove forming machine 200 may be implemented with a plurality of groove forming machines 400. In one aspect, there may be three groove forming machines 400. However, any number of the groove forming machines 400 may be implemented consistent with the disclosure. Each of the groove forming machines 400 may include an inner tool 406 and an outer tool 408 for forming a groove on the tube 199. Additionally, each of the groove forming machines 400 may include a pivotally mounted lever 414 having a wheel 416 arranged at one end. The wheel 416 being configured to contact an outer surface of the tube 199 when the tube 199 is placed on the inner tool 406.

Figure 5:
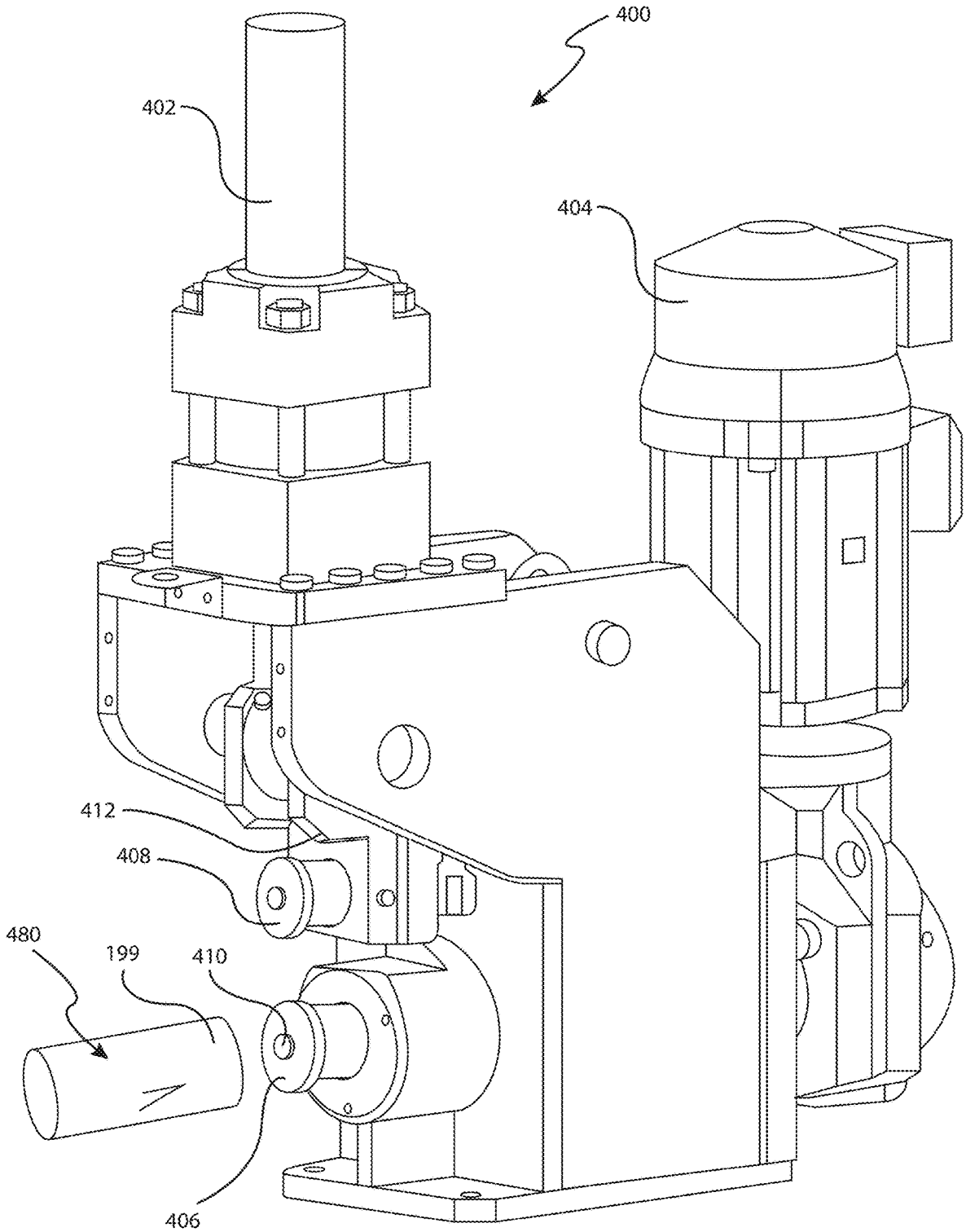
FIG. 5 illustrates a perspective view of the groove forming machine according to FIG. 4.

FIG. 5 illustrates a perspective view of the groove forming machine according to FIG. 4.

In particular, FIG. 5 illustrates the details of the groove forming machine 400. The groove forming machine 400 may include the inner tool 406. The inner tool 406 may be configured to be received inside a tube 199. The groove forming machine 400 may further include an outer tool 408. The outer tool 408 may be configured to contact an outer surface of the tube 199. The combination of the inner tool 406 arranged inside the tube 199 and the outer tool 408 configured to contact an outer surface of the tube 199 may be structured, arranged, and configured to form a groove in the surface of the tube 199. In one aspect, the inner tool 406 may be laterally angled ½ to 1° (as shown by arrow 480) such that during rotation, the tube 199 is moved laterally toward or away from the groove forming machine 200. In other words, the rotational axis of inner tool 406 may be slightly laterally angled (as shown by arrow 480) with respect to a longitudinal axis of the tube 199.

The groove forming machine 400 may further include a motor 404. The motor 404 may be an electric motor having one or more gears, a transmission, and the like to rotate a shaft 410. The inner tool 406 may be rotatably connected and supported by the shaft 410 and the inner tool 406 may be rotated by the shaft 410 in response to rotation of the motor 404. In some aspects, the motor 404 may be implemented using any electromechanical, mechanical, or hydraulic type actuator.

The groove forming machine 400 may further include a hydraulic actuator 402. The hydraulic actuator 402 may be configured to be connected to a support 412 and move the support 412 vertically to place the outer tool 408 in contact with the tube 199; and the hydraulic actuator 402 may be configured to move the support 412 vertically in the opposite direction to place the outer tool 408 out of contact with the tube 199. In some aspects, the hydraulic actuator 402 may be implemented using any electromechanical, mechanical, or hydraulic type actuator.

In operation, the groove forming machine 400 operates such that the motor 404 stops rotation of the inner tool 406 while in a waiting position. The tube 199 is moved by the drive rollers 220 or the drive rollers 222 into a working position towards the groove forming machine 400 and the groove forming machine 400 may translate to insert the inner tool 406 into the tube 199. Thereafter, the motor 404 begins to rotate, which rotates the inner tool 406 as well as the tube 199.

The outer tool 408 may be lowered by the hydraulic actuator 402 and begin to form a groove at the end of the tube 199. When the diameter of the groove reaches the required diameter, the outer tool 408 and the inner tool 406 may continue to rotate for a number of additional turns around the diameter of the tube 199. Thereafter, the outer tool 408 in response to movement of the hydraulic actuator 402 may be raised.

The drive rollers 220 and the drive rollers 222 may then be rotated and the groove forming machine 400 translated from the tube 199 pulling the inner tool 406 out of the tube 199. Thereafter, the groove forming machine 400 may be placed in a waiting position. In one aspect, operation of the groove forming machine 400 may be controlled by the controller 700 illustrated in FIG. 12 that may be responsive to sensors 712.

Figure 6:
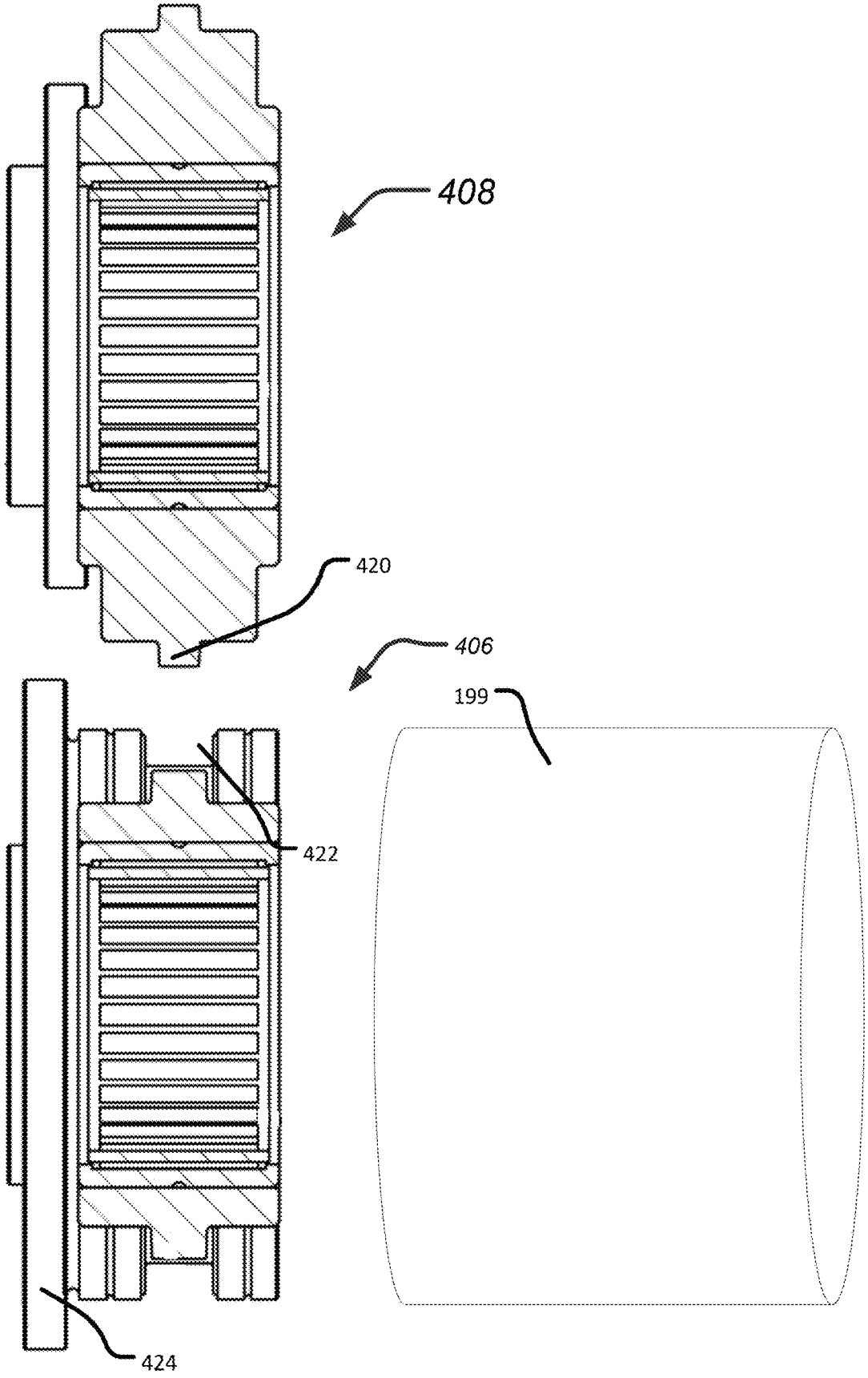
FIG. 6 illustrates a partial cross section view of the groove forming machine according to FIG. 4.

FIG. 6 illustrates a partial cross section view of the groove forming machine according to FIG. 4.

In particular, FIG. 6 illustrates that the outer tool 408 may include an outer tool portion 420; and the inner tool 406 may include an inner tool portion 422. As further illustrated in FIG. 6, the tube 199 may extend onto the inner tool 406. In this regard, FIG. 6 illustrates that the tube 199 is presently not mounted on the inner tool 406. Once the tube 199 is placed on the inner tool 406, as described above, the outer tool 408 may engage the outer surface of the tube 199. More specifically, the outer tool portion 420 may engage the outer surface of the tube 199 and in conjunction with the inner tool portion 422 may form a groove on the outer surface of the tube 199. The inner tool 406 may further include a shoulder 424 that provides a stop for movement of the tube 199 as it moved toward and onto the inner tool 406. This ensures that the groove is formed at the desired location on the tube 199. In other words, the shoulder 424 may have a diameter larger than the diameter of the tube 199 so as to abut an end the tube 199 limiting movement of the tube 199 onto the inner tool portion 406 so that the outer tool portion 420 forms the groove at the desired location.

Figure 7:
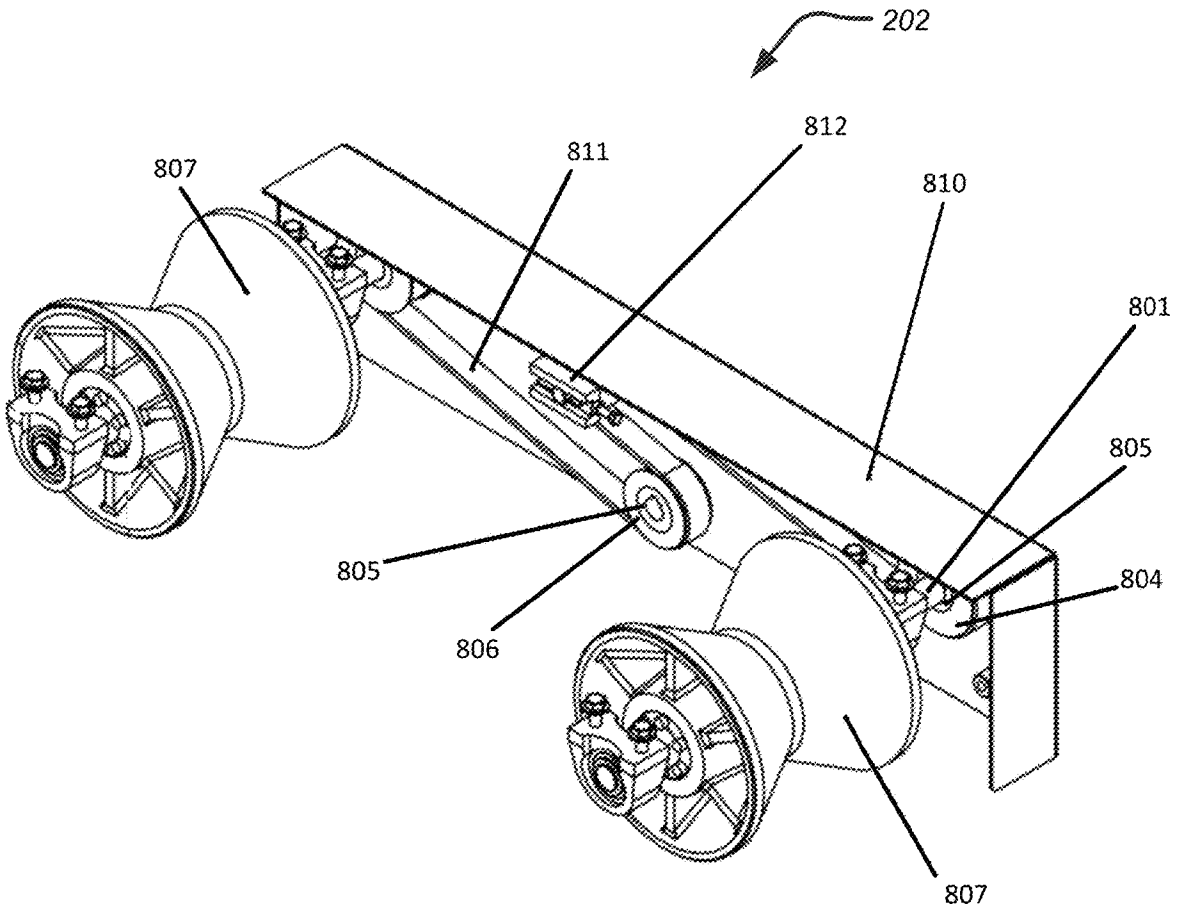
FIG. 7 illustrates a perspective view of a conveyor portion according to FIG. 2.

FIG. 7 illustrates a perspective view of a conveyor portion according to FIG. 2.

In particular, FIG. 7 illustrates the conveyor rollers 202. In one aspect, the conveyor rollers 202 may be a conveyor system that may include a belt tensioner 812, a timing belt 811, a housing 810, a double cone roller 807, a timing pulley 806, a bushing 805, a timing pulley 804, a shaft 801, and the like.

In one aspect, the double cone roller 807 may be mounted on the shaft 801 that is mounted in the bushing 805. In one aspect, the double cone roller 807 may have a V-shaped cross-section to ensure that the tube 199 remains in the central portion of the double cone roller 807. The timing pulley 804 may be rotated by the timing belt 811 and the timing belt 811 may engage with a timing pulley 806 and may be mounted on another bushing 805. In some aspects, the conveyor rollers 202 may include a belt tensioner 812, a timing belt 811, a housing 810, and the like. Rotation of the conveyor rollers 202 including the double cone roller 807 may be in response to operation of a motor (not shown) and controlled by the controller 700 illustrated in FIG. 12 that may be responsive to sensors 712.

Additionally, the conveyor rollers 212 may be implemented in a similar manner to the conveyor rollers 202 with the exception that there may be three parallel sets of the conveyor rollers 202 as illustrated in FIG. 3.

Figure 8:
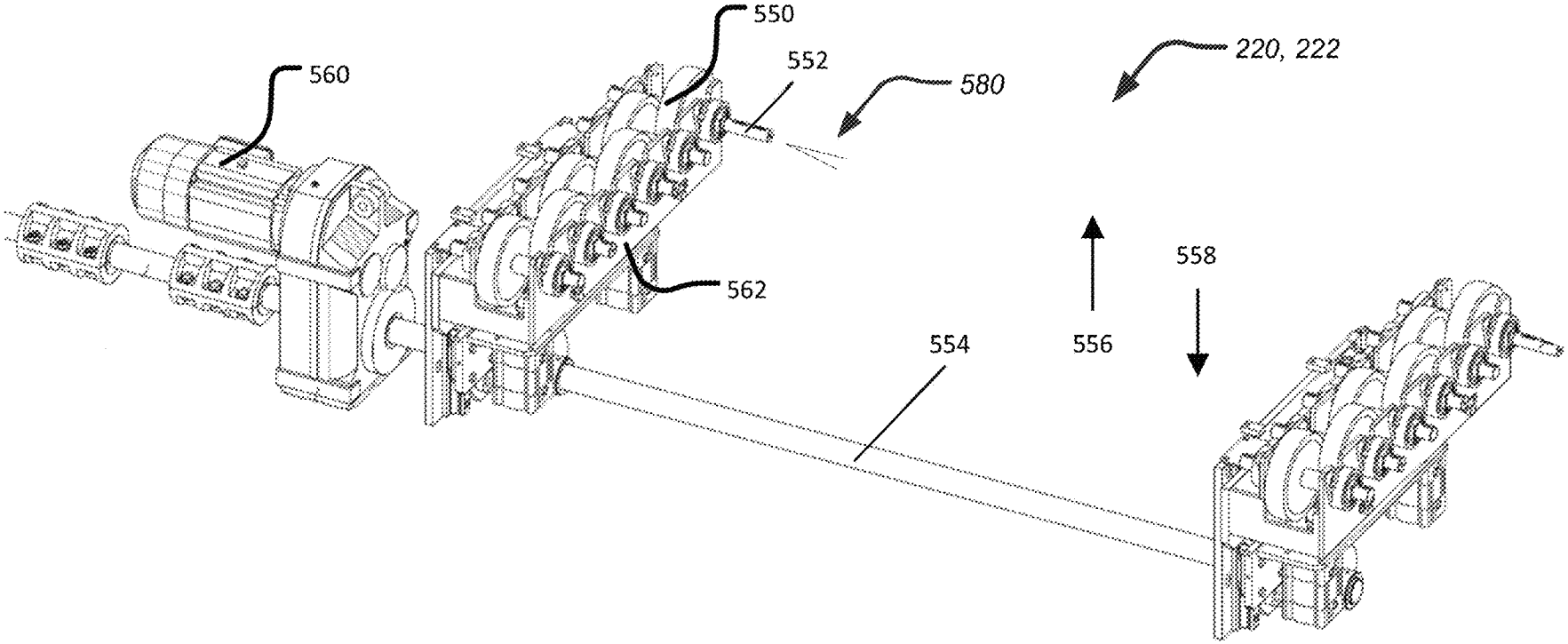
FIG. 8 illustrates a perspective view of a conveyor portion according to FIG. 2.

FIG. 8 illustrates a perspective view of a conveyor portion according to FIG. 2.

In particular, FIG. 8 illustrates the details of the drive rollers 220 or the drive rollers 222. In this regard, in some aspects the drive rollers 220 and the drive rollers 222 may have a similar construction as illustrated in FIG. 8. The drive rollers 220 or the drive rollers 222 may include a plurality of rollers 550 each mounted on a shaft 552. The rollers 550 may rotate in response to operation of a motor 560. In one aspect, the rollers 550 may be laterally angled ½ to 1° (as shown by arrow 580) such that during rotation, the tube 199 is moved laterally toward or away from the groove forming machine 200. In other words, the rotational axis of the rollers 550 may be slightly laterally angled (as shown by arrow 580) with respect to a longitudinal axis of the tube 199. In this regard, rotation of the rollers 550 to laterally move the tube 199 toward the groove forming machine 200 helps ensure that the tube 199 receives the groove at the appropriate location on the tube 199. In particular, the motor 560 may rotate and accordingly rotate a shaft 554 through an intermediate set of gears, transmission, or the like. Additionally, the rollers 550 along with the shafts 552 may be arranged on a support structure 562. The support structure 562 may be configured to move upwardly in the direction of arrow 556 to raise the tubes 199 when the tubes 199 are at positions 5, 6, 7 or at positions 11, 12, 13 to place the tubes 199 in contact with the groove forming machines 200. Additionally, the support structure 562 is configured to move downwardly in the direction of arrow 558 to lower the tubes 199 when the tubes 199 are at positions 5, 6, 7 or at positions 11, 12, 13 to place the tubes 199 out of contact with the groove forming machines 200. In one aspect, movement in the direction of arrow 556 and the arrow 558 may be in response to a hydraulic actuator. The operation of the motor 560 and the hydraulic actuator may be controlled by the controller 700 illustrated in FIG. 12 that may be responsive to sensors 712.

Figure 9:
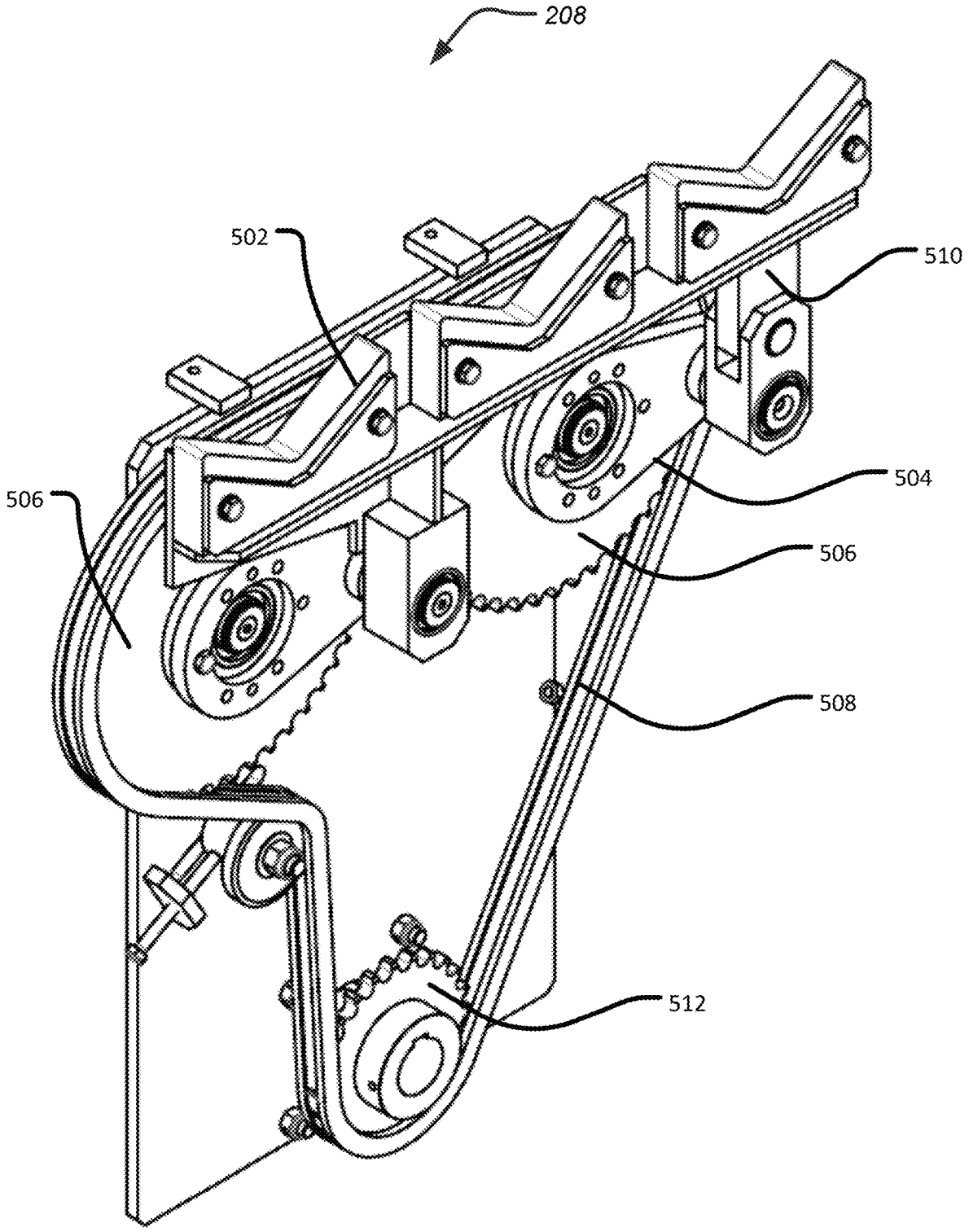
FIG. 9 illustrates a perspective view of a conveyor portion according to FIG. 2.

FIG. 9 illustrates a perspective view of a conveyor portion according to FIG. 2.

In particular, FIG. 9 illustrates the stepper conveyor 208. The stepper conveyor 208 may include a plurality of seat portions 502. In one aspect, the seat portions 502 may have a V-shaped cross-section to ensure that the tube 199 remains in the central portion of the seat portions 502. In one aspect, the stepper conveyor 208 may include three seat portions 502. The seat portions 502 being configured to each receive a tube 199. The seat portions 502 may be arranged on a support 510. The support 510 may be connected to arms 504 that are connected to gears 506. Each rotation of the gears 506 may lift the tube 199 and move it to the next position as illustrated in FIG. 2. The gears 506 may rotate in response to movement of a chain 508, which is driven by a gear 512. The gear 512 may rotate in response to operation of a motor (not shown) and controlled by the controller 700 illustrated in FIG. 12 that may be responsive to sensors 712.

Figure 10:
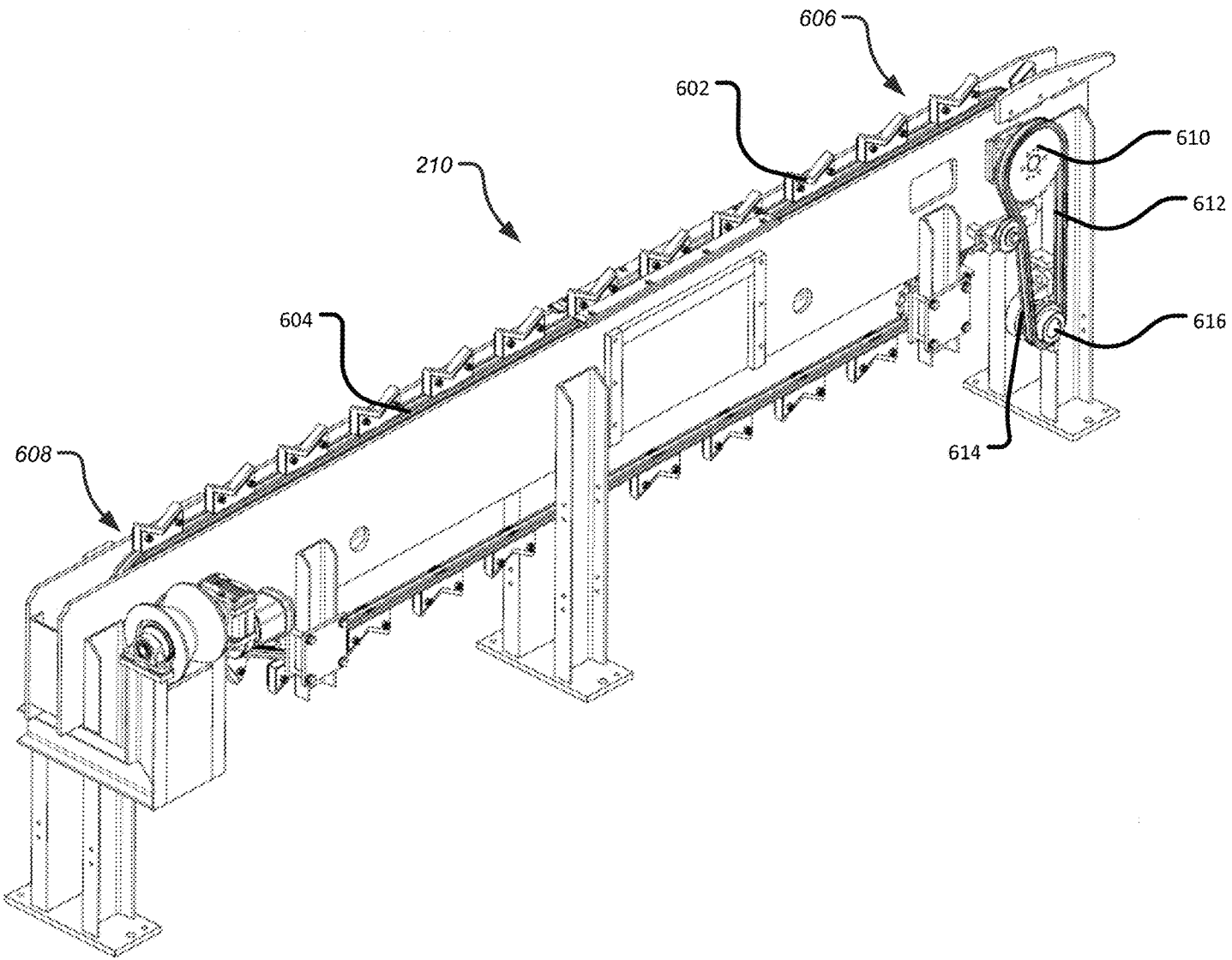
FIG. 10 illustrates a perspective view of a conveyor portion according to FIG. 2.

FIG. 10 illustrates a perspective view of a conveyor portion according to FIG. 2.

In particular, FIG. 10 illustrates the chain conveyor 210. The chain conveyor 210 may include a plurality of seat portions 602. In one aspect, the seat portions 602 may have a V-shaped cross-section to ensure that the tube 199 remains in the central portion of the seat portions 602. Each of the seat portions 602 being configured to hold and move one of the tubes 199. The seat portion 602 may be operatively connected to a chain portion 604. The chain portion 604 together with the seat portions 602 may rotate about an idler gear 608 and a drive gear 606 (both obscured in FIG. 10). The drive gear 606 may be mounted on a common shaft with a driven gear 610 that may be rotated in response to movement of a chain 612. The chain 612 may be additionally connected to a drive gear 616 mounted on a common shaft of a motor 614. The motor 614 may be controlled by the controller 700 illustrated in FIG. 12 that may be responsive to sensors 712.

Figure 11:
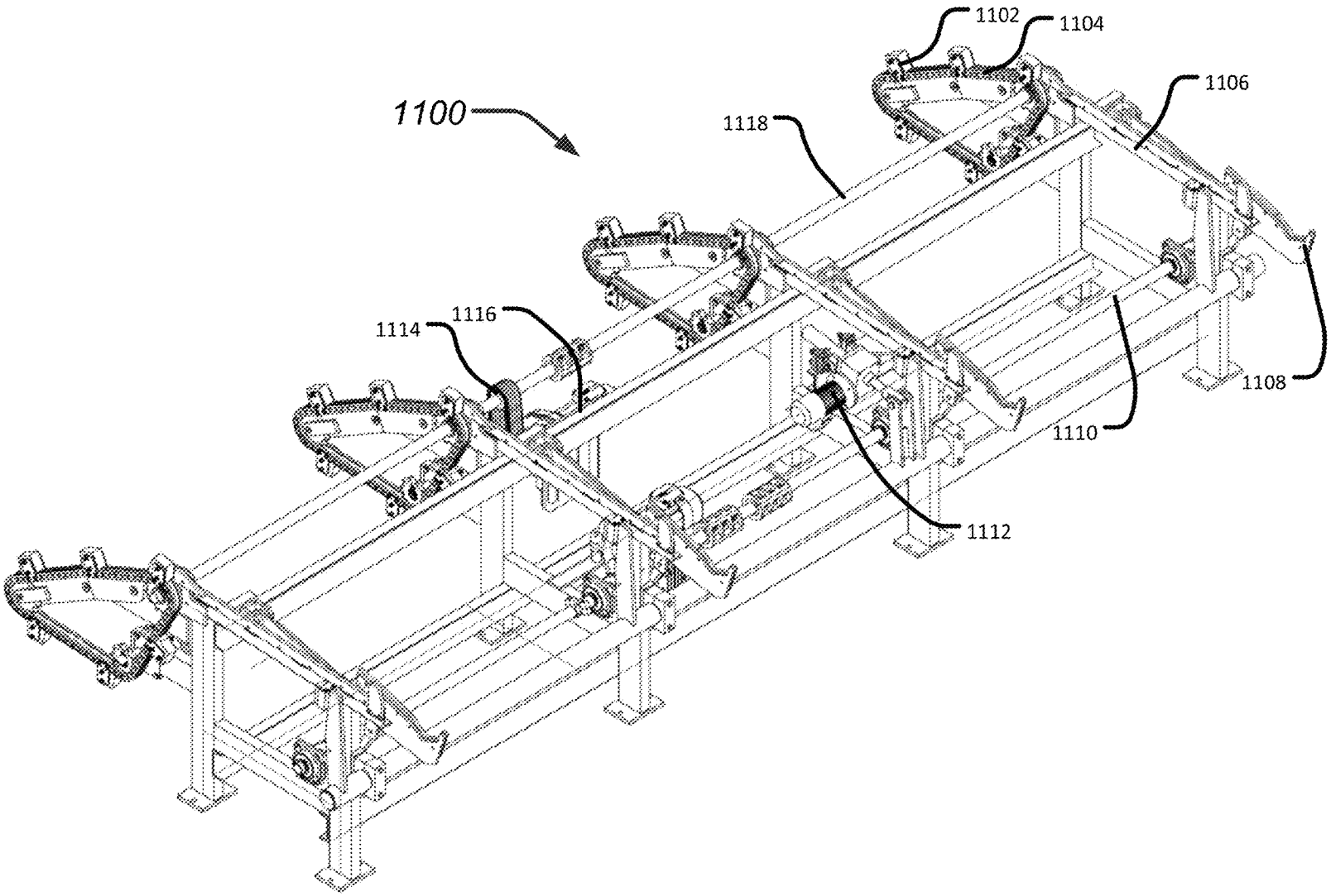
FIG. 11 illustrates a perspective view of a conveyor portion according to an aspect of the disclosure.

FIG. 11 illustrates a perspective view of a conveyor portion according to an aspect of the disclosure.

In particular, FIG. 11 illustrates a conveyor system 1100 configured to convey the tubes 199 from an upstream station of the factory layout 100 to position 1. The conveyor system 1100 may include a chain conveyor that receives the tube 199 in correspondence with a holding portion 1102. The holding portion 1102 may be connected to a chain 1104. The chain 1104 may be driven by a drive gear in response to rotation of the drive shaft 1118. The drive shaft 1118 being driven by a drive chain 1114 that is driven by a motor 1116. Accordingly, rotation of the motor 1116 drives the drive chain 1114 that rotates the drive shaft 1118 that moves the chain 1104 as well as the holding portion 1102 moving the tube 199 up an inclined slope to a plurality of receiver arms 1106. The tubes 199 may roll down with the assistance of gravity the receiver arms 1106. At the end of the receiver arms 1106 are plurality of arms 1108 having a vertical portion that may stop movement of the tubes 199.

In one aspect, the arms 1108 may be pivotally connected to the conveyor system 1100. Additionally, the arms 1108 may be rotated in response to rotation of a motor 1112 and associated transmission and actuation arms, to move the arms 1108 and place the tube 199 on to the conveyor rollers 202 of the grooving station 118.

Figure 12:
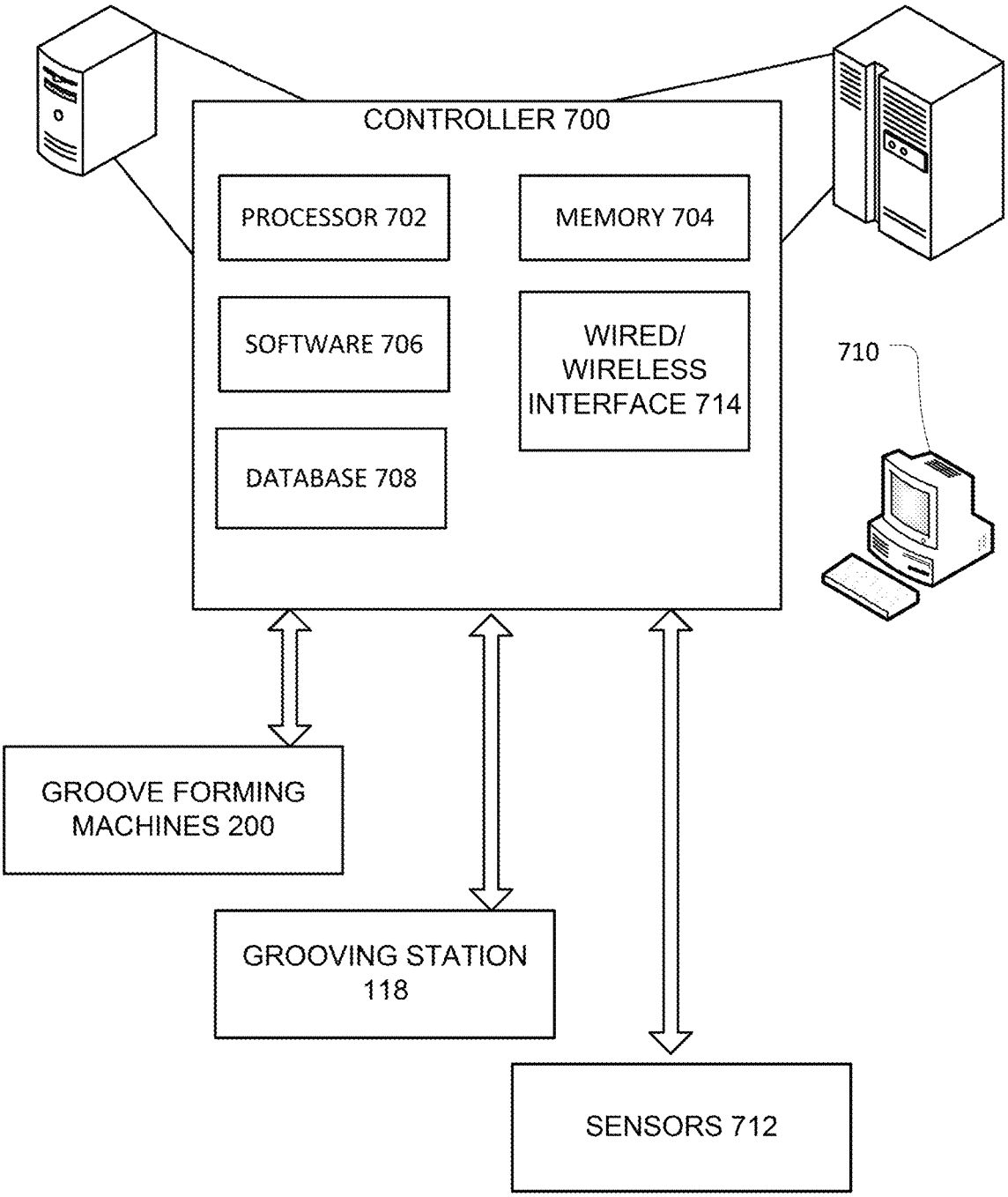
FIG. 12 schematically illustrates a controller for the tube grooving station according to an aspect of the disclosure.

FIG. 12 schematically illustrates a controller for the tube grooving station according to an aspect of the disclosure.

In particular, FIG. 12 illustrates a controller 700 that may be implemented to control the operation of one or more of the grooving station 118, the groove forming machine 200, and the like. The controller 700 may include a processor 702 in communication with a memory 704, which may include software 706 and database 708. The software 706 and the database 708 may be stored in the memory 704 or be stored on a remote computing device located in the mill or outside the mill. Other components of the controller 700 may communicate with a display 710, the sensors 712, a wired/wireless interface 714, and/or the like.

The processor 702 may be any type of processor including a controller, programmable logic controller (PLC), microprocessor, personal computer, one more core processor, ASIC, FPGA, and the like. The memory 704 may be any type of memory including volatile and nonvolatile memory such as RAM, ROM, EPROM, flash, hard drive and the like. The memory 704, in one aspect, may include the software 706, which has computer instructions to control the operation of the groove forming machines 200 and/or grooving station 118 and other components according to the various aspects described herein for manufacture of the tubes 199. In one aspect, the software may be a PC implementing the program language DOT NET Datapack10. In one aspect, the PLC program language may be Rockwell RS Logix. The software may also include instructions to control the entire milling process including the components described in FIG. 1.

The memory 704 may also include the database 708, which may include information about various types of coils used in the milling process including specifications such as length, material of the coils, indicators used on the coils and the like, and the tube which are formed from the coils such as diameter, length, and the like. The database 708 may store various regulations of the United States and other countries such as Canada, Mexico, Brazil, China and the like that are related to the sample testing of the coils such as when to cut the sample and length of the sample. The database 708 may also include other information for use with other components of the grooving station 118 such as information regarding various wireless protocols for the wired/wireless interface 714, and information regarding various indicators that are used in and outside of the U.S. and the like.

The display 710 may be integral with the grooving station 118 or be remote therefrom including in a remote location. The display can be any type of display including TIFF, LED, OLED, Plasma, SVGA, VGA and the like and can include a touch screen surface to interact with the user. The display 710 may communicate via a wired or wireless connection with the processor 702 so that the processor 702 may receive the user's input.

The sensors 712 may be any type of sensor including position, velocity, acoustic, chemical, visual and the like. The sensors 712 may be integral with the grooving station 118 or be remotely positioned to detect the tube 199 as it is being milled. For example, the sensor 712 may be a camera such as a CCD camera, and the like. An image of the tube 199 may be captured by the camera and then compared to images in the database in order to confirm what further actions need to be taken and when. The sensors 712 may communicate with the processor 702, the memory 704, the software 706, the database 708, and the like via a wired or wireless connection. In one aspect, the sensors 712 may include a position/velocity sensor. The position/velocity sensor may be one or more of a capacitive transducer, capacitive displacement sensor, eddy-current sensor, grating sensor, hall effect sensor, inductive non-contact position sensors, linear variable differential transformer (LVDT), multi-axis displacement transducer, photodiode array, piezoelectric transducer (piezo-electric), potentiometer, proximity sensor (optical), rotary encoder (angular), string potentiometer, or the like.

The wired/wireless interface 714 allows for wireless communication with the components of the grooving station 118, other remote computing devices or the components in the milling process (of FIG. 1). The wireless interface may communicate with a network (not shown), which may be the Internet, other distributed network, WLAN, LAN, and the like. In another aspect, the wireless interface may receive a wired connection such as include USB (universal serial bus), FireWire, serial, parallel and the like while wireless connections may be via Wi-Fi, Bluetooth, Zigbee, near field communications, radiofrequency, satellite, cellular and the like. With the wireless interface 714, the processor 702 can be controlled by remote access or allow automated operations. Additionally, the processor 702 may also access information remotely on other computing devices. In one aspect, the controller 700 may be a server.

Figure 13:
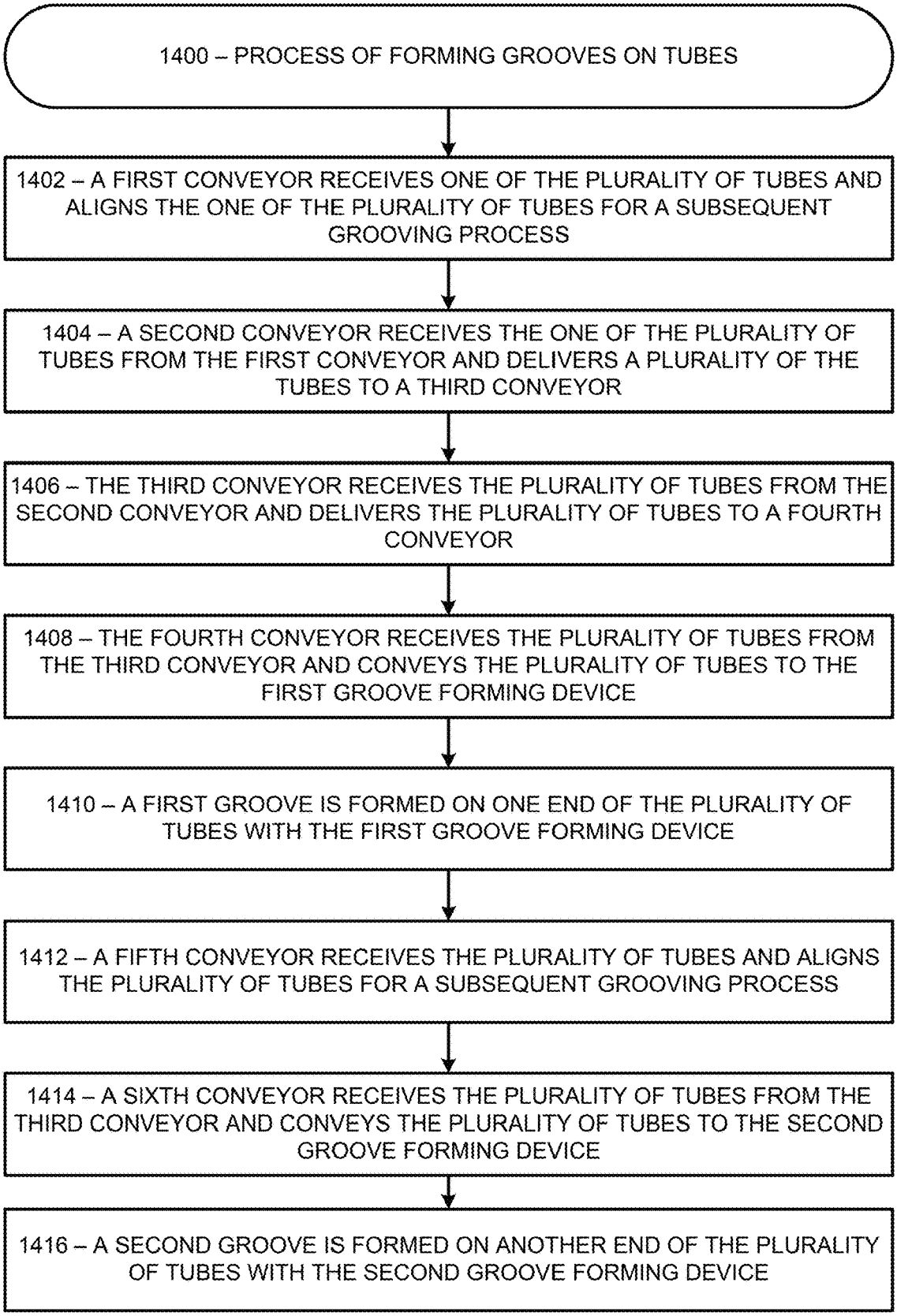
FIG. 13 illustrates a process of forming grooves on tubes in accordance with an aspect of the disclosure.

FIG. 13 illustrates a process of forming grooves on tubes in accordance with an aspect of the disclosure.

In particular, FIG. 13 illustrates a process 1400 of forming grooves on the tubes 199 utilizing the grooving station 118 of the disclosure. As illustrated in box 1402, a first conveyor receives one of the plurality of tubes 199 and aligns the one of the plurality of tubes 199 for a subsequent grooving process. The first conveyor may be the conveyor rollers 202. In this regard, 1402 helps ensure that the tube 199 receives the groove at the appropriate location on the tube 199.

As illustrated in box 1404, a second conveyor receives the one of the plurality of tubes 199 from the first conveyor and delivers a plurality of the tubes to a third conveyor. The second conveyor may be the stepper conveyor 208. As illustrated in box 1406, the third conveyor receives the plurality of tubes 199 from the second conveyor and delivers the plurality the tubes to a fourth conveyor. The third conveyor may be the chain conveyor 210.

As illustrated in box 1408, the fourth conveyor receives the plurality of tubes from the third conveyor and conveys the plurality of tubes to the first groove forming machine 200. The fourth conveyor may be the drive rollers 220. As illustrated in box 1410, a first groove is formed on one end of a plurality of tubes with a first groove forming machine 200.

As illustrated in box 1412, a fifth conveyor receives the plurality of tubes 199 and aligns the plurality of tubes 199 for a subsequent grooving process. The fifth conveyor may be the conveyor rollers 212. In this regard, 1412 helps ensure that the tubes 199 receive the groove at the appropriate location on the tubes 199. As illustrated in box 1414, a sixth conveyor receives the plurality of tubes from the third conveyor and conveys the plurality of tubes to the second groove forming machine 200. The sixth conveyor may be the drive rollers 222.

As illustrated in box 1416, a second groove is formed on another end of the plurality of tubes 199 with the second groove forming machine 200.

Figure 14:
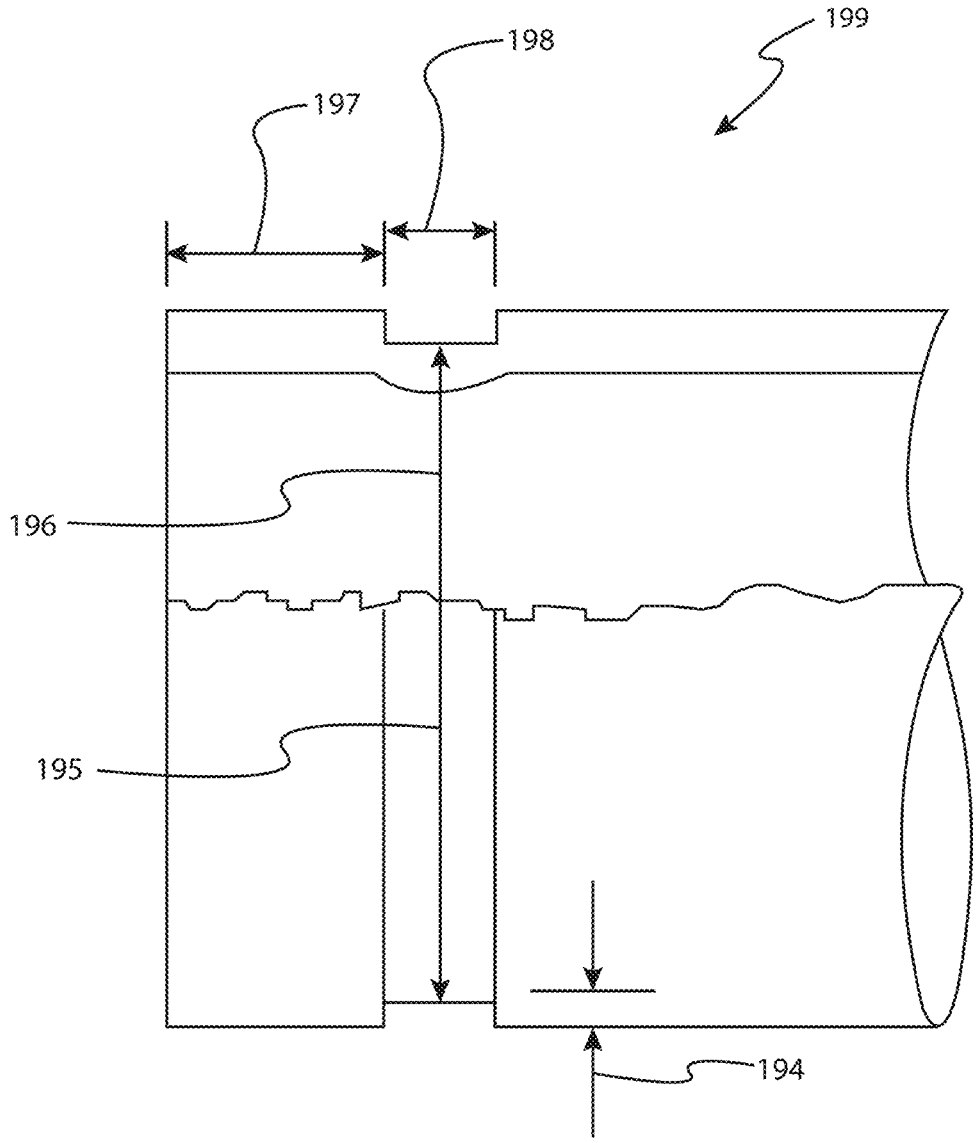
FIG. 14 illustrates an exemplary tube after a grooving process by the tube grooving station according to an aspect of the disclosure.

FIG. 14 illustrates an exemplary tube after a grooving process by the tube grooving station according to an aspect of the disclosure.

In particular, FIG. 14 illustrates the tube 199 after a grooving process by the grooving station 118. The configuration of the outer tool 408 and the inner tool 406 as implemented by the groove forming machine 400 may result in a groove 195 in the tube 199. The groove 195 may be offset from the end of the tube 199 by a distance indicated by arrow 197. The groove 195 may have a width as indicated by arrow 198, a diameter as indicated by arrow 196, and a depth as indicated by arrow 194.

Accordingly, the disclosure has set forth an automated system and process to form grooves on ends of tubes 199 with increased speed as well as improved quality. In particular, implementing a groove forming machine 200 configured to form grooves on a plurality of tubes 199 simultaneously increases speed. Moreover, implementing a groove forming machine 200 at each end of the tube 199 further increases speed. Additionally, the various alignment processes and disclosed devices and processes result in improved quality. In particular, the disclosed combination of conveyors, controller, sensors, and alignment processes help ensure that the tube 199 receives the groove at the appropriate location on the tube 199.

Aspects of the disclosure may include a server executing an instance of an application or software configured to accept requests from a client and giving responses accordingly. The server may run on any computer including dedicated computers. The computer may include at least one processing element, typically a central processing unit (CPU), and some form of memory. The processing element may carry out arithmetic and logic operations, and a sequencing and control unit may change the order of operations in response to stored information. The server may include peripheral devices that may allow information to be retrieved from an external source, and the result of operations saved and retrieved. The server may operate within a client-server architecture. The server may perform some tasks on behalf of clients. The clients may connect to the server through the network on a communication channel as defined herein. The server may use memory with error detection and correction, redundant disks, redundant power supplies and so on.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The many features and advantages of the disclosure are apparent from the detailed specification, and thus, it is intended by the appended claims to cover all such features and advantages of the disclosure which fall within the true spirit and scope of the disclosure. Further, since numerous modifications and variations will readily occur to those skilled in the art, it is not desired to limit the disclosure to the exact construction and operation illustrated and described, and accordingly, all suitable modifications and equivalents may be resorted to, falling within the scope of the disclosure.

What is claimed is:

1. A groove forming station configured in-line in a tube mill and further configured to simultaneously form a groove on an end of a plurality of tubes, comprising:

a conveyor system configured to receive each of the plurality of tubes and align each of the plurality of tubes for a subsequent grooving process;

a first groove forming device configured to form a first groove on each end of the plurality of tubes;

the first groove forming device comprising first inner tools configured to be each inserted into different ones of the plurality of tubes and first outer tools configured to each contact an outer surface of different ones of the plurality of tubes to form the first groove on one end of the plurality of tubes;

a second groove forming device configured to form a second groove on another end of the plurality of tubes; and the second groove forming device comprising second inner tools configured to be each inserted into different ones of the plurality of tubes and second outer tools configured to each contact an outer surface of different ones of the plurality of tubes to form the second groove on another end of the plurality of tubes, wherein the conveyor system is configured to convey the plurality of tubes to the first groove forming device; and wherein the conveyor system being further configured to convey the plurality of tubes to the second groove forming device.

2. The groove forming station of claim 1, wherein the conveyor system is configured to elevate the plurality of tubes to the first groove forming device; and wherein the conveyor system is configured to elevate the plurality of tubes to the second groove forming device.

3. The groove forming station of claim 1, wherein the conveyor system comprises a first conveyor configured to receive each of the plurality of tubes and align each of the plurality of tubes for a subsequent grooving process.

4. The groove forming station of claim 3, wherein the conveyor system comprises a second conveyor configured to receive each of the plurality of tubes from the first conveyor and deliver the plurality of tubes to a third conveyor.

5. The groove forming station of claim 4, wherein the conveyor system comprises the third conveyor configured to receive the plurality of tubes from the second conveyor and deliver the plurality the tubes to a fourth conveyor.

6. The groove forming station of claim 5, wherein the conveyor system comprises the fourth conveyor configured to receive the plurality of tubes from the third conveyor and convey the plurality of tubes to the first groove forming device.

7. The groove forming station of claim 6, wherein the conveyor system comprises a fifth conveyor configured to receive the plurality of tubes and align the plurality of tubes for a subsequent grooving process and return the plurality of tubes to the third conveyor.

8. The groove forming station of claim 7, wherein the conveyor system comprises a sixth conveyor configured to receive the plurality of tubes from the third conveyor and convey the plurality of tubes to the second groove forming device.

9. The groove forming station of claim 8, wherein the first conveyor moves each of the plurality of tubes against a stop to align each of the plurality of tubes for the subsequent grooving process;

wherein the first conveyor comprises a plurality of rollers to support and align each of the plurality of tubes for the subsequent grooving process;

wherein the second conveyor comprises a stepper conveyor;

wherein the third conveyor comprises a chain conveyor;

wherein the fourth conveyor is configured to elevate the plurality of tubes to the first groove forming device;

the first groove forming device being configured to receive the plurality of tubes from the fourth conveyor to form a groove on one end of the plurality of tubes;

the fourth conveyor further configured to deliver the plurality of tubes to the third conveyor;

wherein the fifth conveyor moves the plurality of tubes against a stop to align the plurality of tubes for the subsequent grooving process;

wherein the fifth conveyor comprises a plurality of rollers to support and align the plurality of tubes for the subsequent grooving process;

wherein the sixth conveyor is configured to elevate the plurality of tubes to the second groove forming device; and the second groove forming device being configured to receive the plurality of tubes from the sixth conveyor to form a groove on another end of the plurality of tubes.

10. The groove forming station of claim 1, further comprising a controller responsive to at least one sensor, the controller configured to control the conveyor system, the first groove forming device, and the second groove forming device.

11. A groove forming process for simultaneously forming a groove on an end of a plurality of tubes in-line in a tube mill, comprising:

receiving each of the plurality of tubes and aligning each of the plurality of tubes for a subsequent grooving process with a conveyor system;

forming a first groove on one end of the plurality of tubes with a first groove forming device;

implementing the first groove forming device with first inner tools configured to be each inserted into different ones of the plurality of tubes and first outer tools configured to each contact an outer surface of different ones of the plurality of tubes to form the first groove on one end of the plurality of tubes;

forming a second groove on another end of the plurality of tubes with a second groove forming device; and implementing the second groove forming device with second inner tools configured to be each inserted into different ones of the plurality of tubes and second outer tools configured to each contact an outer surface of different ones of the plurality of tubes to form the second groove on another end of the plurality of tubes, wherein the conveyor system is configured to convey the plurality of tubes to the first groove forming device; and wherein the conveyor system being further configured to convey the plurality of tubes to the second groove forming device.

12. The groove forming process of claim 11, wherein the conveyor system is configured to elevate the plurality of tubes to the first groove forming device; and wherein the conveyor system is configured to elevate the plurality of tubes to the second groove forming device.

13. The groove forming process of claim 11, wherein the conveyor system comprises a first conveyor configured to receive each of the plurality of tubes and align the each of the plurality of tubes for a subsequent grooving process.

14. The groove forming process of claim 13, wherein the conveyor system comprises a second conveyor configured to receive the each of the plurality of tubes from the first conveyor and deliver the plurality of tubes to a third conveyor.

15. The groove forming process of claim 14, wherein the conveyor system comprises the third conveyor configured to receive the plurality of tubes from the second conveyor and deliver the plurality of tubes to a fourth conveyor.

16. The groove forming process of claim 15, wherein the conveyor system comprises the fourth conveyor configured to receive the plurality of tubes from the third conveyor and convey the plurality of tubes to the first groove forming device.

17. The groove forming process of claim 16, wherein the conveyor system comprises a fifth conveyor configured to receive the plurality of tubes and align the plurality of tubes for a subsequent grooving process and return the plurality of tubes to the third conveyor.

18. The groove forming process of claim 17, wherein the conveyor system comprises a sixth conveyor configured to receive the plurality of tubes from the third conveyor and convey the plurality of tubes to the second groove forming device.

19. The groove forming process of claim 18, wherein the first conveyor moves each of the plurality of tubes against a stop to align each of the plurality of tubes for the subsequent grooving process;

wherein the first conveyor comprises a plurality of rollers to support and align each of the plurality of tubes for the subsequent grooving process;

wherein the second conveyor comprises a stepper conveyor;

wherein the third conveyor comprises a chain conveyor;

wherein the fourth conveyor configured to elevate the plurality of tubes to the first groove forming device;

the first groove forming device being configured to receive the plurality of tubes from the fourth conveyor to form a groove on one end of the plurality of tubes;

the fourth conveyor further configured to deliver the plurality of tubes to the third conveyor;

wherein the fifth conveyor moves the plurality of tubes against a stop to align the plurality of tubes for the subsequent grooving process;

wherein the fifth conveyor comprises a plurality of rollers to support and align the plurality of tubes for the subsequent grooving process, wherein the sixth conveyor is configured to elevate the plurality of tubes to the second groove forming device; and the second groove forming device being configured to receive the plurality of tubes from the sixth conveyor to form a groove on another end of the plurality of tubes.

20. The groove forming process of claim 11, further comprising controlling with a controller responsive to at least one sensor the conveyor system, the first groove forming device, and the second groove forming device.

* * * * *